US006609443B2

(12) United States Patent
Murray

(10) Patent No.: US 6,609,443 B2
(45) Date of Patent: Aug. 26, 2003

(54) COMFORT GRIP HAMMER

(76) Inventor: Michael John Murray, 2578 Silverwood Dr., Gainesville, GA (US) 30507

( * ) Notice: Subject to any disclaimer, the term of this patent is extended or adjusted under 35 U.S.C. 154(b) by 0 days.

(21) Appl. No.: 09/924,043

(22) Filed: Aug. 7, 2001

(65) Prior Publication Data

US 2002/0029664 A1 Mar. 14, 2002

Related U.S. Application Data

(63) Continuation-in-part of application No. 09/506,875, filed on May 17, 2000, now abandoned.

(51) Int. Cl.[7] ..... B25D 1/00
(52) U.S. Cl. ..... 81/20; 81/177.1
(58) Field of Search ..... 81/20, 177.1, 489; 16/110.1, 421, 430

(56) References Cited

U.S. PATENT DOCUMENTS

| | | | | | |
|---|---|---|---|---|---|
| 4,154,273 | A | * | 5/1979 | Pollak | 81/20 |
| 4,548,248 | A | * | 10/1985 | Riemann | 81/20 |
| 4,941,232 | A | * | 7/1990 | Decker et al. | 16/421 |
| 5,046,387 | A | * | 9/1991 | Levake | 81/489 |
| 5,588,343 | A | * | 12/1996 | Rust et al. | 81/20 |
| 6,009,600 | A | * | 1/2000 | Egeland et al. | 16/430 |
| 6,049,936 | A | * | 4/2000 | Holley | 16/430 |
| 6,367,113 | B1 | * | 4/2002 | Usui | 16/430 |

* cited by examiner

*Primary Examiner*—James G. Smith
(74) *Attorney, Agent, or Firm*—Michael J. Murray

(57) ABSTRACT

An improved striking tool handle grip used with standard heads such as hammers, hatchets or axes, wherein the grip is tapered from a point closest to the head to the opposite end of the handle and is elliptical in shape. There is therefore no two points on the grip where the radii, measured from the centerline of the handle, is the same. The amount of taper is substantially five degrees.

6 Claims, 2 Drawing Sheets

Figure 1:
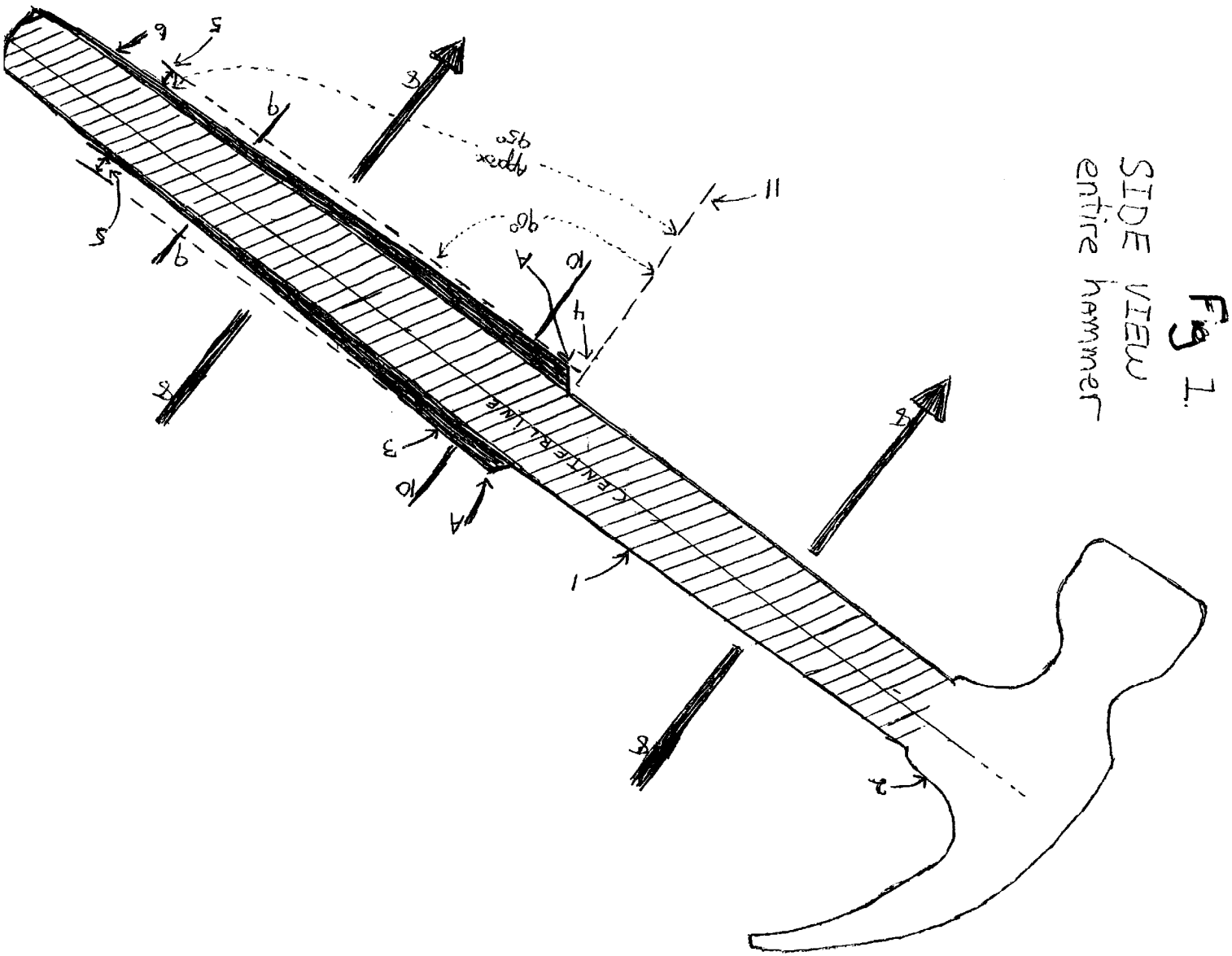

SIDE VIEW
entire hammer

Fig 2 SIDE VIEW grip only
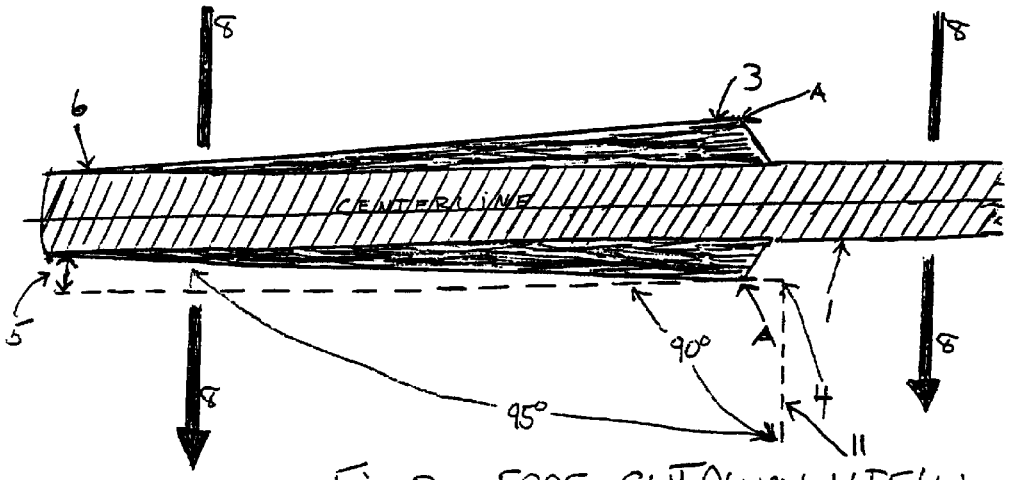
Fig 3. rear CUTAWAY VIEW Along line 9-9 on fig 1.
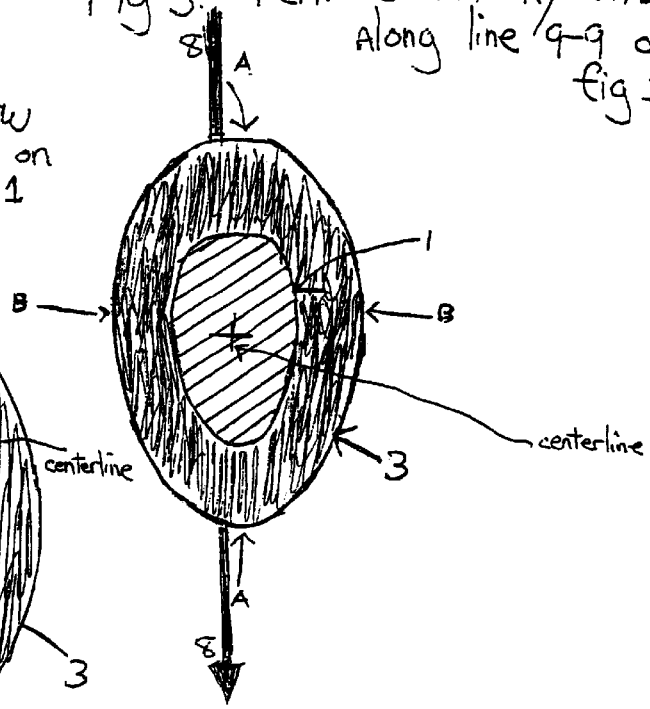
rear CUTAWAY VIEW Along line 10-10 on fig. 1
Fig 4.
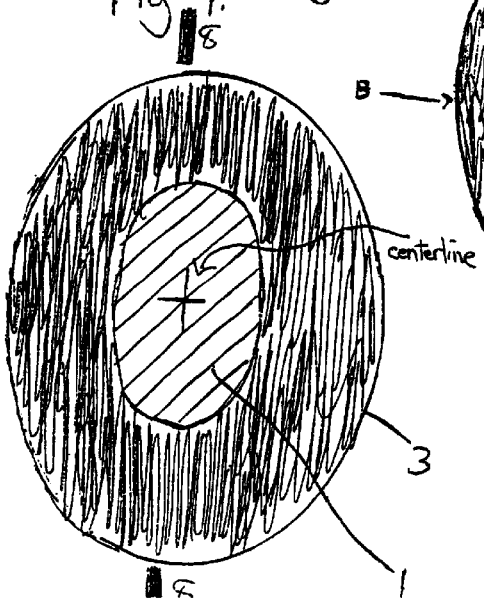

COMFORT GRIP HAMMER

This is a continuation in part of application Ser. No. 09/506,875 and filing date May 17, 2000 ABDN.

BACKGROUND OF INVENTION

1. Field of Invention

The sole purpose pf this invention is to address the problem of maintaining and securing a comfortable grip after extended use. This invention only relates to the gripping end of the hammer or any other striking tool that incorporates the use of only one hand to operate the tool. A uniquely shaped gripping handle would be molded onto gripping end of the shaft. It would be constructed out of any synthetic rubber resin used commonly nowadays for other grips. This grip would offer the most natural and comfortable grip one could obtain on a hammer or other striking tool.

2. Description of Prior Art

Every tradesman, carpenter, contractor, and homeowner can attest to all prior art on hammers and such. Molded handles, rubber handles, and curved handles make up numerous types of striking tools. Much prior art goes into well thought details of the grip alone. However, the idea of manipulating the users hand to be the most relaxed, yet stable and secure grip seems to be missed. Only the shape of an inverted and elliptical cone can obtain that. Prior art such as U.S. Pat. No. 6,009,600 by Egeland et al, U.S. Pat. No. 5,046,387 by Leake, U.S. Pat. No. 4,154,273 by Pollak, U.S. Pat. No. 4,548,248 by Riemann, U.S. Pat. No. 5,588,343 by Rust et al all seem to manipulate the users hand in every conceivable shape except the shape one would have keeping the striking motion the least strenuous. Whereas, the comfort e-z grip is the farthest users hand can be extended still maintaining a secure grip. Any other wider range of the hand being extended would result in loose of grip or wider and impractical grip. My invention accomplishes this only shape to obtain the most comfortable grip. U.S. Pat. No. 4,154,273 by Pollack portrays a tapered handle almost to the likes of mine on the bottom of the handle; it is virtually flat on the top. See U.S. Pat. No. 4,154,273 figure one side view. The top of the handle in Figure one side view is practically parallel with the shaft of the hammer inside it. Area by which the users thumb and index finger seems to decrease with the top of the handle, actually bending downwards. This is in sharp contrast to the shape of my handle. My grip on figure one side view shows an area of the handle increasing as you see it rise to where the thumb and index finger rest on the handle. Any wider grip would be impractical for obvious reasons; clumsiness, size, and lose of grip. I do not believe U.S. Pat. No. 4,154,273 total intent for uniquness was for its grip but rather for its 130-degree bend where the shaft meets the handle change arm motion when using. It still doesn't extend the hand out far enough for a more comfortable grip. As for U.S. Pat. No. 6,009,600 figure one, item twenty five is virtually flat with no resemblances of a cone, whether inverted or not, whatsoever. Figures two and three U.S. Pat. No. 6,009,600, both top and bottom views are similar to my grip, but figure one, U.S. Pat. No. 6,009,600 confirms my uniquness and claims. U.S. Pat. No. 5,045,387 by Leake inventions seems to address job-site conditions, where moisture is present. It also shows handles on handheld tools that are tapered in some manner. It also shows recessed finger grips. Figure nine of U.S. Pat. No. 5,046,387 somewhat resembles a cone inverted. It shows the largest area and circumference at the opposite where it should be inverted to obtain my grip. The largest part of my invention is on the top, (thumb, forefinger), not the bottom by the pinky finger as shown in Figure nine. Figure twelve does show a tapered back to the grip. It also shows the front part of the grip with recessed fingertip contouring the same shape as the back. The area of the grip remains the same as it rises to the top, where it meets the shaft. This would not constitute a cone, whether inverted or not. Only with a cone, does the volume of area increase as the cone is viewed from point to outer circumference whether it is circular or elliptical. Figure twelve confirms this is not the case. Figure fourteen, U.S. Pat. No. 5,046,387 side view shows the front part of handle, with recessed finger grips on a flat plane until it rises to the top of the handle where it protrudes inward toward the contour of the back of the handle. There is no increase in volume of area as the handle rises toward the shaft. In this case, the handle and shaft are one. It is still in contrast to my invention. Once again, I believe by reading the context of U.S. Pat. No. 5,046,387, the handle is not the sole object for uniquness, but for its moisture resistances. The only similarity between my invention and U.S. Pat. No. 4,548,248 by Riemann would be the use of recessed fingertips. Other than that, there is no similarity between that invention and mine. By viewing figure one, U.S. Pat. No. 4,548,248; one can see no inverted cone shape whatsoever. U.S. Pat. No. 5,588,343 by Rust et al, also have no similarity to mine as being shaped entirely different then mine. The main objective of this invention seems to be with the tensile strength of synthetic materials used to combine the shaft to the handle.

SUMMARY

The entire scope of this invention would be that by manipulating the hand into the most relaxed, yet secure position, the user of this invention would expend less energy to perform the task of striking motion. This is done by employing an inverted elliptical cone as the main member of the grip where the users pinky finger rests on the grip, which would be the smallest of the elliptical diameter. Where the users thumb and forefinger rest on the grip would be the largest of the elliptical diameter, these dimensions would manipulate the entire hand outward towards a more relaxed position rather then a so densed fist. By employing a gradual taper from one end of the grip to the other ensures a comfortable and secure grip without it feeling too bulky. It would be molded with recessed finger grips along the bottom of the grip.

DESCRIPTION OF EACH FIGURE

Figure one is a side elevation view of a hammer employing the present invention.

Figure two is also a side elevation detailing the hammer grip only. It is shown along line 8—8 as to retain continually.

Figure three is a transverse sectional view on the handle along line 9—9.

Figure four is also a transverse (not to scale) sectional view of the handle along line 10—10 on figure one.

DESCRIPTION OF PREFERRED EMBODIMENTS

This is a relatively simple invention. By changing the shape of the gripping area only, one can change the position of ones hand to accommodate the novelty and uniqueness of said invention. By viewing FIG. 1, the handle is labeled numeral 1 and is shown by diagonal lines. It extends from head 2 to the grip 3. Numeral 4 denotes area of grip 3 where it is at its thickest point occupying the most space. Radius from the centerline to apogees and perigees noted by numeral 4 are at their longest at this point part of the grip. The letter A on figure one and figure three denote the apogee of the elliptical shape of the grip in accordance to the center of handle 1. Numeral 6 denotes the area of said grip 3 where it is at its smallest point occupying the least space. This is where the radius from the centerline to apogees and perigees are the shortest providing the tapering need for this invention. Please be noted that letter A, the apogee is also the same at numeral 6 since the whole grip is elliptical. However, the radius from the centerline is considerably shorter to apogee. Numeral 5 denotes the approximate five degree angle increase to surface of grip 3 in accordance to the ninety degree angle formed by intersection of the imaginary line perpendicular to the handle denoted by numeral 11 and the point farthest from the thickest part of grip 3 located at point of grip denoted by numeral 4 on figure one and two. These lines are drawn at apogee. Recessed finger grips have been left out of figure one and figure two for clarity. Figure two is a partial view of figure one as noted by line 8. It is however being viewed from the right side as opposed to being viewed from the left side as in figure one. Figure two clearly shows the inverted cone shape grip occupying more space as it moves up to numeral 4. Please note that the letter A denotes the apogee of elliptical shape since elliptical shape cannot be seen on both figure one and figure two, and numeral 4 represents the entire apogee and perigee at that portion of grip 3. Numeral 4 is the mass; letter A is a fixed point. Figure three shows a transverse cross-section along line 9—9 on figure one. Note the elliptical shape as found in most hammers today. The letter A represents the apogees in accordance to shaft 1. The letter B shows the perigees of grips 3 in accordance to shaft 1. Figure four clearly shows the uniqueness and novelty of the invention. It shows the grip 3 at line 10—10 located on the grip 3 in figure one. However, figure four is not to scale. It does show the increase of mass of grip 3 as it progresses to point of grip shown by numeral 4 on both figure one and two. The radius from centerline to both perigee and apogee are longer showing the obviousness of the invention. This provides the added tapered mass of grip 3 in accordance with the structure of a cone. No other shape can claim this.

What is claimed is:

1. A striking tool having an impact head and an attached handle, the improvement comprising:

a grip portion on an end the handle opposite the impact head, said grip portion tapering from an end closest to the impact head to an opposite end such that the radii at one point on said grip portion are different than at all other points along said grip portion, said grip portion having a elliptical cross section in a plane that is perpendicular to a center axis of the handle.

2. A striking tool as recite in claim 1 wherein the taper is substantially five degrees.

3. A striking tool as recite in claim 1 wherein said grip portion is provided with finger grip recess along one side thereof.

4. A striking tool as recited in claim 1 wherein the impact head is a hammerhead.

5. A striking tool as recited in claim 1 wherein the impact head is a hatchet head.

6. A striking tool as recited in claim 1 wherein the impact head is an ax head.

* * * * *